US010661116B2

(12) United States Patent
Giannelli et al.

(10) Patent No.: US 10,661,116 B2
(45) **Date of Patent: *May 26, 2020**

(54) BACK EXTENSION EXERCISE APPARATUS

(71) Applicant: Cybex International, Inc., Owatonna, MN (US)

(72) Inventors: Raymond Giannelli, Franklin, MA (US); Mark Buontempo, Millville, MA (US); Stephen Wendt, Owatonna, MN (US)

(73) Assignee: Cybex International, Inc., Owatonna, MN (US)

( * ) Notice: Subject to any disclaimer, the term of this patent is extended or adjusted under 35 U.S.C. 154(b) by 31 days.

This patent is subject to a terminal disclaimer.

(21) Appl. No.: 16/102,792

(22) Filed: Aug. 14, 2018

(65) Prior Publication Data

US 2018/0353808 A1 Dec. 13, 2018

Related U.S. Application Data

(63) Continuation of application No. 15/584,081, filed on May 2, 2017, now Pat. No. 10,166,435, which is a (Continued)

(51) Int. Cl.
*A63B 23/02* (2006.01)
*A63B 21/008* (2006.01)
(Continued)

(52) U.S. Cl.
CPC ..... *A63B 23/0205* (2013.01); *A63B 21/005* (2013.01); *A63B 21/0083* (2013.01);
(Continued)

(58) Field of Classification Search
CPC .. A63B 23/0211; A63B 23/0233–0238; A63B 21/062–0632
See application file for complete search history.

(56) References Cited

U.S. PATENT DOCUMENTS 4,227,689 A * 10/1980 Keiser ..... A63B 21/0087 482/113
4,725,054 A 2/1988 Lu
(Continued)

FOREIGN PATENT DOCUMENTS

EP 2644230 10/2013
EP 2644230 A1 10/2013
(Continued)

OTHER PUBLICATIONS

Int'l. Search Report and Written Opinion from priority application PCT/US2015/019837.
(Continued)

*Primary Examiner* — Jennifer Robertson
(74) *Attorney, Agent, or Firm* — Andrus Intellectual Property Law, LLP

(57) ABSTRACT

An exercise apparatus for performing a back extension exercise comprising: a frame, a seat having a seating surface and a pelvic stabilization pad having a lower back engagement surface, an input arm assembly interconnected by a first interconnection to a first resistance mechanism, the input arm assembly including a manually graspable mechanism and being arranged on the apparatus such that the input arm assembly is pivotable beginning from a start motionless position along a path of travel toward the pelvic stabilization pad under resistance exerted by one or both of the resistance mechanisms, wherein the first resistance mechanism is adapted to increase resistance as the degree of pivoting of the input arm assembly increases along the path of travel away from the start motionless position rearwardly toward the pelvic stabilization pad.

8 Claims, 11 Drawing Sheets

Related U.S. Application Data continuation of application No. 14/989,166, filed on Jan. 6, 2016, now Pat. No. 9,707,432, which is a continuation of application No. PCT/US2015/019837, filed on Mar. 11, 2015.

(60) Provisional application No. 61/951,011, filed on Mar. 11, 2014, provisional application No. 61/951,026, filed on Mar. 11, 2014, provisional application No. 61/951,034, filed on Mar. 11, 2014, provisional application No. 61/951,046, filed on Mar. 11, 2014, provisional application No. 61/951,059, filed on Mar. 11, 2014.

(51) Int. Cl.

| | |
|---|---|
| ***A63B 21/02*** | (2006.01) |
| ***A63B 21/062*** | (2006.01) |
| ***A63B 21/00*** | (2006.01) |
| ***A63B 21/005*** | (2006.01) |
| ***A63B 21/055*** | (2006.01) |
| ***A63B 21/04*** | (2006.01) |
| ***A63B 23/12*** | (2006.01) |
| ***A63B 23/035*** | (2006.01) |
| ***A63B 21/012*** | (2006.01) |

(52) U.S. Cl.

CPC ..... *A63B 21/0085* (2013.01); *A63B 21/0087* (2013.01); *A63B 21/023* (2013.01); *A63B 21/0428* (2013.01); *A63B 21/055* (2013.01); *A63B 21/0552* (2013.01); *A63B 21/063* (2015.10); *A63B 21/0628* (2015.10); *A63B 21/154* (2013.01); *A63B 21/4033* (2015.10); *A63B 21/4039* (2015.10); *A63B 21/4047* (2015.10); *A63B 23/0233* (2013.01); *A63B 23/03525* (2013.01); *A63B 23/1209* (2013.01); *A63B 21/0088* (2013.01); *A63B 21/012* (2013.01); *A63B 21/155* (2013.01); *A63B 21/4035* (2015.10); *A63B 2208/0238* (2013.01); *A63B 2225/09* (2013.01)

(56) References Cited

U.S. PATENT DOCUMENTS

| | | | | |
|---|---|---|---|---|
| 4,842,266 | A | 6/1989 | Sweeney, Sr. et al. | |
| 5,114,388 | A | 5/1992 | Trulaski | |
| 5,254,066 | A | 10/1993 | Brown et al. | |
| 5,597,375 | A | 1/1997 | Simonson | |
| 5,897,467 | A | 4/1999 | Habing et al. | |
| 5,913,752 | A * | 6/1999 | Bolf | A63B 22/0076 482/112 |
| 5,967,954 | A | 10/1999 | Habing | |
| 6,004,247 | A | 12/1999 | Webber | |
| 6,071,216 | A | 6/2000 | Giannelli | |
| 6,142,917 | A | 11/2000 | Giannelli | |
| 6,254,516 | B1 | 7/2001 | Giannelli | |
| 6,287,243 | B1 | 9/2001 | Isom | |
| D486,535 | S | 2/2004 | Giannelli | |
| D490,127 | S | 5/2004 | Giannelli | |
| 7,338,415 | B2 | 3/2008 | Giannelli | |
| 7,364,535 | B1 | 4/2008 | Rosenow | |
| 7,563,214 | B2 | 7/2009 | Webber et al. | |
| 7,666,123 | B2 | 2/2010 | Giannelli | |
| D612,437 | S | 3/2010 | Fenster | |
| D613,350 | S | 4/2010 | Fenster | |
| 7,717,831 | B2 | 5/2010 | Giannelli | |
| 7,717,836 | B1 | 5/2010 | Miller | |
| 7,753,830 | B1 | 7/2010 | Marsh | |
| 7,938,760 | B1 | 5/2011 | Webber et al. | |
| 7,993,251 | B1 | 8/2011 | Webber et al. | |
| 8,025,609 | B2 | 9/2011 | Giannelli | |
| 8,113,996 | B1 | 2/2012 | Allen | |
| 8,118,720 | B2 | 2/2012 | Sebastian | |
| 8,734,304 | B2 * | 5/2014 | Webber | A63B 21/0628 482/140 |
| 9,707,432 | B2 * | 7/2017 | Giannelli | A63B 21/078 |
| 9,981,155 | B2 | 5/2018 | Giannelli et al. | |
| 10,004,935 | B2 | 6/2018 | Giannelli et al. | |
| 10,166,435 | B2 * | 1/2019 | Giannelli | A63B 21/0087 |
| 2002/0022556 | A1 | 2/2002 | Eriksson | |
| 2002/0052268 | A1 | 5/2002 | Morcillo-Quintero et al. | |
| 2002/0198087 | A1 | 12/2002 | Mitchell | |
| 2003/0092543 | A1 | 5/2003 | Giannelli | |
| 2003/0171193 | A1 | 9/2003 | Deola | |
| 2003/0171195 | A1 | 9/2003 | Giannelli et al. | |
| 2005/0032614 | A1 | 2/2005 | Keiser | |
| 2006/0116253 | A1 | 6/2006 | Nizam | |
| 2006/0211549 | A1 | 9/2006 | Noheji | |
| 2006/0270531 | A1 | 11/2006 | Giannelli | |
| 2006/0293153 | A1 | 12/2006 | Porth et al. | |
| 2007/0238589 | A1 | 10/2007 | Webber | |
| 2008/0167169 | A1 | 7/2008 | Giannelli | |
| 2010/0009818 | A1 | 1/2010 | Simonson et al. | |
| 2010/0016128 | A1 | 1/2010 | Webber et al. | |
| 2010/0019128 | A1 | 1/2010 | Webber | |
| 2010/0105530 | A1 | 4/2010 | Inaisumi | |
| 2010/0105533 | A1 | 4/2010 | Noheji | |
| 2010/0204021 | A1 | 8/2010 | Giannelli | |
| 2011/0301002 | A1 | 12/2011 | Sebastian | |
| 2012/0032262 | A1 | 2/2012 | Toren et al. | |
| 2016/0114207 | A1 | 4/2016 | Giannelli et al. | |
| 2018/0133536 | A1 | 5/2018 | Webber et al. | |

FOREIGN PATENT DOCUMENTS

| | | |
|---|---|---|
| FR | 2174414 | 12/1973 |
| JP | 3183390 | 5/2013 |
| KR | 100834880 | 5/2008 |
| WO | 1996026766 | 9/1996 |
| WO | 2008017049 | 2/2008 |

OTHER PUBLICATIONS

Cybex Eagle NX Abdominal (NPL1).
Cybex Prestige Abdominal (NPL1).
Cybex VR1 Abdominal (NPL2).
Cybex VR1 Duals Abdominals/Back Extension (NPL3).
EP Search Report, EP Patent Application No. 15715524.3, dated Nov. 19, 2018.

* cited by examiner

BACK EXTENSION EXERCISE APPARATUS

RELATED APPLICATIONS

This application is a continuation of U.S. application Ser. No. 15/584,081 filed May 2, 2017, which is a continuation of Ser. No. 14/989,166 filed Jan. 6, 2016 which is a continuation of PCT/US2015/019837, filed Mar. 11, 2015, which claims the benefit of priority to U.S. Provisional Application No. 61/951,011 filed Mar. 11, 2014 and U.S. Provisional Application No. 61/951,059 filed Mar. 11, 2014 and U.S. Provisional Application No. 61/951,026 filed Mar. 11, 2014 and U.S. Provisional Application No. 61/951,034 filed Mar. 11, 2014 and U.S. Provisional Application No. 61/951,046 filed Mar. 11, 2014 and U.S. Provisional Application No. 61/951,059, filed Mar. 11, 2014, the disclosures of all of which are incorporated herein by reference in their entirety as if fully set forth herein.

This application incorporates by reference the disclosures of all of the following in their entirety as if fully set forth herein: U.S. Pat. Nos. 7,717,831, 4,725,054, 7,666,123, 8,070,658, 7,278,955, 8,025,609, 7,727,128, D486,535, D490,127, U.S. Patent Publication No. 2003/0092541, U.S. Patent Publication No. 2007/0173384, U.S. Patent Publication No. 2006/0270531, U.S. Patent Publication No. 2008/0167169, U.S. Patent Publication No. 2010/0204021.

FIELD OF THE INVENTION

The present invention relates to physical exercise machines and more particularly to an exercise apparatus that enables users to perform an abdominal muscle exercise that is resisted by one or more resistance mechanisms.

BACKGROUND OF THE INVENTION

Exercise machines for exercising abdominal muscles are known and used for directing movement of a user upper torso by forcing the user to use the user's abdominal muscles against a weight resistance. In such machines the force that the user is required to exert typically starts at zero and increases at a very high rate of increase immediately upon engagement by the user with the assembly, arm or the like that is interconnected to the weight resistance.

SUMMARY OF THE INVENTION

In accordance with the invention there is provided an exercise apparatus for performing a back extension exercise by a user 5, FIG. 5, having a lower back, legs and a trunk that has a longitudinal trunk axis and a trunk weight, the apparatus comprising:

a frame, a seat 16, FIGS. 1-4, having a seating surface PS and a pelvic stabilization pad 18 having a lower back engagement surface ES, the seating surface PS and the pelvic stabilization pad 18 being mounted, adapted and arranged on the frame in a disposition relative to each other such that the user can simultaneously sit on the seating surface and engage the user's lower back against the lower back engagement surface, an input arm assembly 30 interconnected by a first interconnection 47, 60, 70 to a first resistance mechanism 43 and by a second interconnection (48, 50) to a second manually selectively adjustable fixed weight resistance mechanism 42, the input arm assembly including a manually graspable mechanism **30*h* and being arranged on the apparatus such that the input arm assembly is pivotable beginning from a start motionless position SMP along a path of travel toward the pelvic stabilization pad 18 under resistance R1, R2 exerted by one or both of the resistance mechanisms, the input arm assembly being arranged on the apparatus such that when the user 5 is seated on the seating surface and the user's lower back 7 is engaged against the lower back engagement surface ES, the seat and the pelvic stabilization pad position the user in a position at which EXT the user can manually engage ME the manually graspable mechanism 30*h* to pull the input arm assembly beginning from the start motionless position SMP toward the pelvic stabilization pad along the path of travel PT against resistance R1, R2 exerted by one or both of the first 43 and second 42** resistance mechanisms.

The first resistance mechanism is adapted to increase resistance as the degree of pivoting of the input arm assembly increases along the path of travel PT away from the start motionless position SMP toward the pelvic stabilization pad.

The seat and the pelvic stabilization pad are preferably arranged on the apparatus such that when the user is seated on the seat with the user's lower back engaged against the lower back engaging surface and the input arm assembly is disposed in the start motionless position, the user's trunk axis LA, FIG. 5, is disposed at a forward angle EXT relative to vertical VP leaning away from the pelvic stabilization pad and toward the input arm assembly when the user manually engages ME the manually graspable mechanism.

The seat and the pelvic stabilization pad are preferably arranged on the apparatus such that when the user manually engages ME and pulls the input arm assembly from the start motionless toward the pelvic stabilization pad, the user's trunk axis pivots backwardly from the forward angle and travels from the forward angle toward a vertical disposition, the user's lower back being opposed by less force from the trunk weight and more resistance from the first resistance mechanism as the user's trunk axis approaches a vertical disposition.

The first resistance mechanism can comprise an extendable spring that increases in resistance as the spring is increasingly extended, the spring being interconnected to the input arm assembly in an arrangement such that movement of the input arm assembly along the path of travel toward the pelvic stabilization pad increasingly extends the spring and movement toward the start motionless position reduces extension of the spring.

Alternatively, the first resistance mechanism can comprise an enclosed cylinder having a piston slidably mounted within the cylinder forming opposing fluid sealed chambers within the piston, the piston being interconnected to a rod that extends outside the enclosed cylinder for driving the piston, the chambers containing a selected compressible fluid, the rod being interconnected to the input arm assembly and driven by movement of the input arm assembly from the start motionless position toward the pelvic stabilization pad to cause fluid in at least one of the chambers to compress and increase resistance against movement of the input arm assembly with an increase in the degree of compression of the fluid.

The seating surface (PS) is preferably generally disposed in a plane disposed at a downwardly sloping angle relative to horizontal, the seat having a downwardly disposed front end and an upwardly disposed rear end, the pelvic stabilization pad being mounted such that the lower back engagement surface is disposed at the upwardly disposed rear end of the seating surface in an arrangement that engages the user's lower back when the user is seated on the seating surface and pushing the user's lower back toward the pelvic stabilization pad with the user's legs.

The apparatus preferably includes a foot pad 20 mounted forwardly relative to the seat, the foot pad being arranged on the apparatus such that the user can engage the foot pad with the user's foot and push on the foot pad with the user's leg to push the user's lower back into engagement with the lower back engagement surface while seated on the seat.

The lower back engagement surface is typically generally circular CES, RA, CD, FIG. 4, in radial cross-section.

The input arm assembly (32) is preferably interconnected to the first resistance mechanism (43) by a cable (70), the arm assembly being interconnected to a cam (60) having a receiving groove (CP) that receives the cable, the cam (60) being interconnected to the arm assembly such that the cam rotates together with pivoting of the input arm assembly, the receiving groove having a profile (CP1, CP2) selected to create a lesser torque force (F1*a*) against the user's pulling force (F1) when the user starts pulling the arm assembly from the start motionless position and gradually increase torque force (F2*a*) against the user's pulling force F2 as the user continues to pull the input arm assembly rearwardly.

In another aspect of the invention there is provided a method of performing a back extension exercise using the apparatus described immediately above comprising the user's:

seating the user's trunk on top of the seat of the apparatus described immediately above, pushing the user's lower back into engagement against the lower back engaging surface while seated on the seat, leaning the user's trunk forwardly such that the user's trunk axis is disposed at a forward angle sufficient to enable the user to manually engage the manually graspable mechanism with the input arm assembly in the start motionless position, and pulling the input arm assembly from the start motionless position rearwardly toward the pelvic stabilization pad.

In another aspect of the invention there is provided an exercise apparatus for performing a back extension exercise by a user having a lower back, legs and a trunk that has a longitudinal trunk axis and a trunk weight, the apparatus comprising:

a frame, a seat (16) having a seating surface (PS) and a pelvic stabilization pad (18) having a lower back engagement surface (ES), the seating surface and the pelvic stabilization pad being mounted, adapted and arranged on the frame in a disposition relative to each other such that the user can simultaneously sit on the seating surface and engage the user's lower back against the lower back engagement surface, an input arm assembly (30) interconnected by a first interconnection to a first resistance mechanism and by a second interconnection to a second manually selectively adjustable fixed weight resistance mechanism, the input arm assembly including a manually graspable mechanism and being arranged on the apparatus such that the input arm assembly is pivotable beginning from a start motionless position along a path of travel toward the pelvic stabilization pad under resistance exerted by one or both of the resistance mechanisms, wherein the first resistance mechanism is adapted to increase resistance as the degree of pivoting of the input arm assembly increases along the path of travel away from the start motionless position toward the pelvic stabilization pad.

In such an apparatus the input arm assembly is preferably arranged on the apparatus such that when the user is seated on the seating surface and the user's lower back is engaged against the lower back engagement surface, the seat and the pelvic stabilization pad position the user in a position at which the user can manually engage the manually graspable mechanism to pull the input arm assembly beginning from the start motionless position toward the pelvic stabilization pad along the path of travel against resistance exerted by one or both of the first and second resistance mechanisms.

The seat and the pelvic stabilization pad are preferably arranged on the apparatus such that when the user is seated on the seat with the user's lower back engaged against the lower back engaging surface and the input arm assembly is disposed in the start motionless position, the user's trunk axis is disposed at a forward angle relative to vertical leaning away from the pelvic stabilization pad and toward the input arm assembly when the user manually engages the manually graspable mechanism.

The seat and the pelvic stabilization pad are preferably arranged on the apparatus such that when the user manually engages and pulls the input arm assembly from the start motionless toward the pelvic stabilization pad, the user's trunk axis pivots backwardly from the forward angle and travels from the forward angle toward a vertical disposition, the user's lower back being opposed by less force from the trunk weight and more resistance from the first resistance mechanism as the user's trunk axis approaches a vertical disposition.

The first resistance mechanism typically comprises an extendable spring that increases in resistance as the spring is increasingly extended, the spring being interconnected to the input arm assembly in an arrangement such that movement of the input arm assembly along the path of travel toward the pelvic stabilization pad increasingly extends the spring and movement toward the start motionless position reduces extension of the spring.

Alternatively, the first resistance mechanism can comprise an enclosed cylinder having a piston slidably mounted within the cylinder forming opposing fluid sealed chambers within the piston, the piston being interconnected to a rod that extends outside the enclosed cylinder for driving the piston, the chambers containing a selected compressible fluid, the rod being interconnected to the input arm assembly and driven by movement of the input arm assembly from the start motionless position toward the pelvic stabilization pad to cause fluid in at least one of the chambers to compress and increase resistance against movement of the input arm assembly with an increase in the degree of compression of the fluid.

The seating surface (PS) is typically generally disposed in a plane disposed at a downwardly sloping angle relative to horizontal, the seat having a downwardly disposed front end and an upwardly disposed rear end, the pelvic stabilization pad being mounted such that the lower back engagement surface is disposed at the upwardly disposed rear end of the seating surface in an arrangement that engages the user's lower back when the user is seated on the seating surface and pushing the user's lower back toward the pelvic stabilization pad with the user's legs.

The apparatus preferably includes a foot pad mounted forwardly relative to the seat, the foot pad being arranged on the apparatus such that the user can engage the foot pad with the user's foot and push on the foot pad with the user's leg to push the user's lower back into engagement with the lower back engagement surface while seated on the seat.

The lower back engagement surface is typically generally circular in radial cross-section.

In another aspect of the invention there is provided a method of performing a back extension exercise using the apparatus described immediately above comprising the user's:

seating the user's trunk on top of the seat of the apparatus, pushing the user's lower back into engagement against the lower back engaging surface while seated on the seat, leaning the user's trunk forwardly such that the user's trunk axis is disposed at a forward angle sufficient to enable the user to manually engage the manually graspable mechanism with the input arm assembly in the start motionless position, and pulling the input arm assembly from the start motionless position rearwardly toward the pelvic stabilization pad.

In another aspect of the invention there is provided an exercise apparatus for performing a back extension exercise by a user having a lower back, legs and a trunk that has a longitudinal trunk axis and a trunk weight, the apparatus comprising:

a frame, a seat (16) having a seating surface (PS) and a pelvic stabilization pad (18) having a lower back engagement surface (ES), the seating surface and the pelvic stabilization pad being mounted, adapted and arranged on the frame in a disposition relative to each other such that the user can simultaneously sit on the seating surface and engage the user's lower back against the lower back engagement surface, an input arm assembly (30) interconnected by a first interconnection to a first resistance mechanism, the input arm assembly including a manually graspable mechanism and being arranged on the apparatus such that the input arm assembly is pivotable beginning from a start motionless position along a path of travel toward the pelvic stabilization pad under resistance exerted by one or both of the resistance mechanisms, wherein the first resistance mechanism is adapted to increase resistance as the degree of pivoting of the input arm assembly increases along the path of travel away from the start motionless position toward the pelvic stabilization pad.

Such an apparatus preferably includes a second interconnection to a second manually selectively adjustable fixed weight resistance mechanism.

The input arm assembly is preferably arranged on the apparatus such that when the user is seated on the seating surface and the user's lower back is engaged against the lower back engagement surface, the seat and the pelvic stabilization pad position the user in a position at which the user can manually engage the manually graspable mechanism to pull the input arm assembly beginning from the start motionless position toward the pelvic stabilization pad along the path of travel against resistance exerted by one or both of the first and second resistance mechanisms.

The seat and the pelvic stabilization pad are preferably arranged on the apparatus such that when the user is seated on the seat with the user's lower back engaged against the lower back engaging surface and the input arm assembly is disposed in the start motionless position, the user's trunk axis is disposed at a forward angle relative to vertical leaning away from the pelvic stabilization pad and toward the input arm assembly when the user manually engages the manually graspable mechanism.

The seat and the pelvic stabilization pad are preferably arranged on the apparatus such that when the user manually engages and pulls the input arm assembly from the start motionless toward the pelvic stabilization pad, the user's trunk axis pivots backwardly from the forward angle and travels from the forward angle toward a vertical disposition, the user's lower back being opposed by less force from the trunk weight and more resistance from the first resistance mechanism as the user's trunk axis approaches a vertical disposition.

The first resistance mechanism preferably comprises an extendable spring that increases in resistance as the spring is increasingly extended, the spring being interconnected to the input arm assembly in an arrangement such that movement of the input arm assembly along the path of travel toward the pelvic stabilization pad increasingly extends the spring and movement toward the start motionless position reduces extension of the spring.

Alternatively, the first resistance mechanism can comprise an enclosed cylinder having a piston slidably mounted within the cylinder forming opposing fluid sealed chambers within the piston, the piston being interconnected to a rod that extends outside the enclosed cylinder for driving the piston, the chambers containing a selected compressible fluid, the rod being interconnected to the input arm assembly and driven by movement of the input arm assembly from the start motionless position toward the pelvic stabilization pad to cause fluid in at least one of the chambers to compress and increase resistance against movement of the input arm assembly with an increase in the degree of compression of the fluid.

The seating surface (PS) is preferably generally disposed in a plane disposed at a downwardly sloping angle relative to horizontal, the seat having a downwardly disposed front end and an upwardly disposed rear end, the pelvic stabilization pad being mounted such that the lower back engagement surface is disposed at the upwardly disposed rear end of the seating surface in an arrangement that engages the user's lower back when the user is seated on the seating surface and pushing the user's lower back toward the pelvic stabilization pad with the user's legs.

The apparatus typically includes a foot pad mounted forwardly relative to the seat, the foot pad being arranged on the apparatus such that the user can engage the foot pad with the user's foot and push on the foot pad with the user's leg to push the user's lower back into engagement with the lower back engagement surface while seated on the seat.

The lower back engagement surface is preferably generally circular in radial cross-section.

In another aspect of the invention there is provided a method of performing a back extension exercise using the apparatus described immediately above comprising the user's:

seating the user's trunk on top of the seat of the apparatus, pushing the user's lower back into engagement against the lower back engaging surface while seated on the seat, leaning the user's trunk forwardly such that the user's trunk axis is disposed at a forward angle sufficient to enable the user to manually engage the manually graspable mechanism with the input arm assembly in the start motionless position, and pulling the input arm assembly from the start motionless position rearwardly toward the pelvic stabilization pad.

In another aspect of the invention there is provided an exercise apparatus for performing a back extension exercise by a user comprising:

a frame, an input arm assembly being interconnected by a first interconnection to a spring resistance mechanism the input arm assembly being interconnected by a second interconnection to a manually selectively adjustable weight resistance mechanism, a seat having a generally planar seating surface PS and pelvic stabilization pad having a lower back engagement surface ES having a central radial axis RA, the seating surface PS being generally disposed in a plane disposed at a downwardly sloping angle relative to horizontal, the seating surface and the lower back engagement surface being mounted, adapted and arranged relative to each other such that the seating surface and the central radial axis are disposed at an obtuse angle relative to each other, wherein the input arm assembly is mounted, arranged and adapted to enable the user to manually pull on the arm assembly to perform a pulling exercise while seated on the seat with the user's lower back engaged against the lower back engagement surface.

The input arm assembly of such an apparatus is typically mounted to the frame to be rotatable around a pivot axis and the input arm assembly is interconnected to the spring resistance mechanism such that when the user pulls on the arm in a direction that causes the arm to rotate, the arm pulls on the spring which exerts an opposing resistance force against the exercise force of the user.

The lower back engagement surface is preferably generally circular in cross-section, the central radial axis RA extending from or intersecting the center of a circle in which the circular circumference is disposed through the center or half way around the circumference of the generally circumferential surface ES.

The input arm assembly (32) is preferably interconnected to the first resistance mechanism (43) by a cable (70), the arm assembly being interconnected to a cam (60) having a receiving groove (CP) that receives the cable, the cam (60) being interconnected to the arm assembly such that the cam rotates together with pivoting of the input arm assembly, the receiving groove having a profile (CP1, CP2) selected to create a lesser torque force (F1*a*) against the user's pulling force (F1) when the user starts pulling the arm assembly from the start motionless position and gradually increase torque force (F2*a*) against the user's pulling force F2 as the user continues to pull the input arm assembly rearwardly

BRIEF DESCRIPTION OF THE DRAWINGS

The above and further advantages of the invention may be better understood by referring to the following description in conjunction with the accompanying drawings in which:

FIG. 2AA is rear perspective view of the FIG. 1 apparatus.

DETAILED DESCRIPTION

Figure 1:
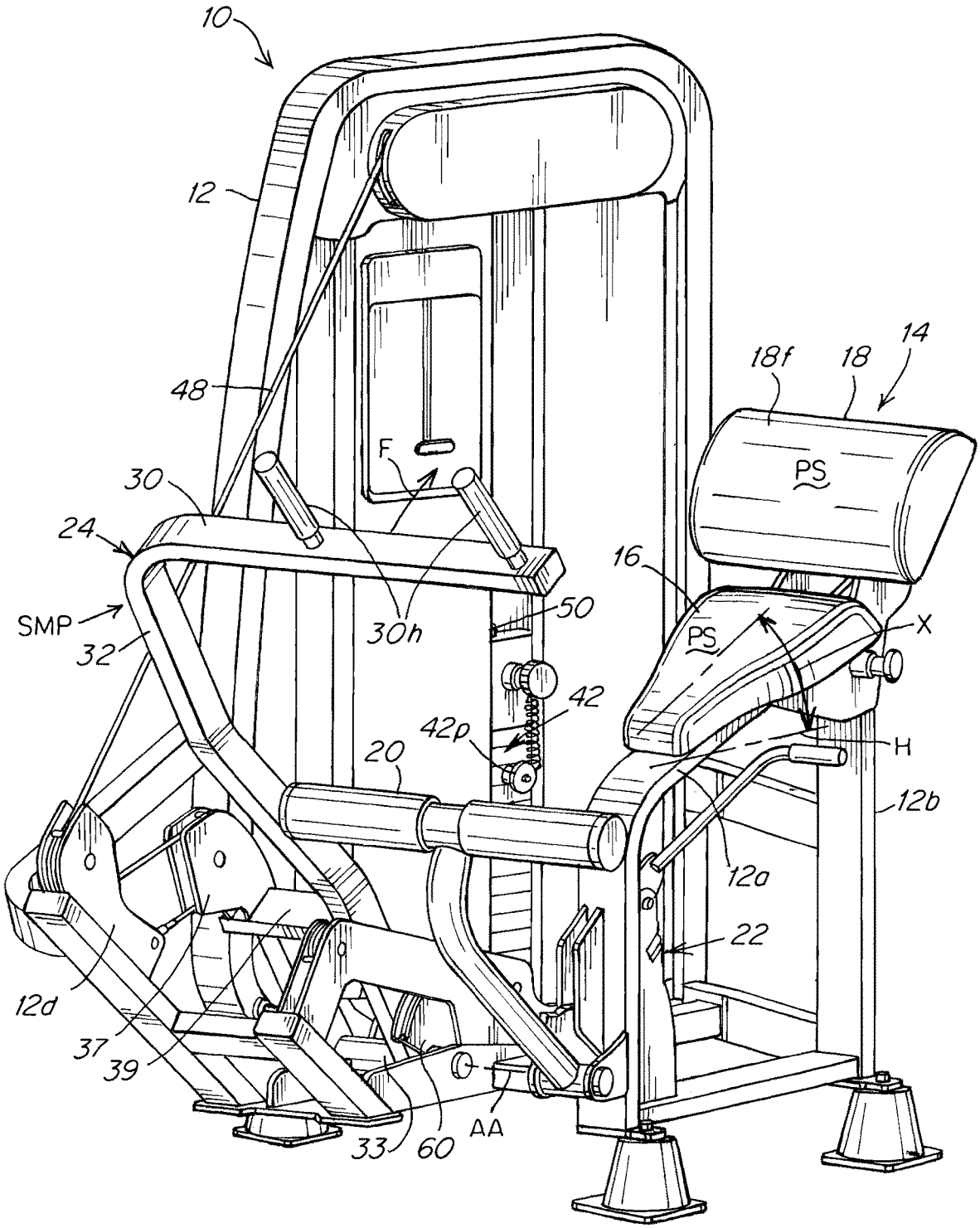
FIG. 1 is a top side-front perspective view of a back extension and abdominal exercise apparatus according to the invention with the input arm assembly in a start, motionless position.

The present state of the art in back extension weight training machines allows for movement of the torso in a rotational pattern against some sort of variable resistance (typically from a weight stack). As the torso moves through its normal range of motion, gravity also has a variable effect on the torque developed around the axis of rotation. The more horizontal the torso is to the ground, the greater the effective moment arm which defined as the horizontal distance from the center of gravity to the instant center of rotation of the spine. The problem is created in the present art due to the difference in these two resistive loads (the resistance from the weight stack and the resistance from gravity) and how they vary based on the user capability. It is possible to have a user with a large heavy torso that has limited muscular capacity to create a high torque load around the spine, or a light small framed user that has a high capacity to create a high torque load around the spine. This would create a situation where the variation in the resistance would create the need for a completely different cam shape based on what the difference was in frame size and muscle capacity. One way to solve this problem is to create two different resistance sources. One to counterbalance the torso and the other to provide resistance for the abdominal muscles to work against as the trunk rotates anteriorly around the instant center of rotation in spinal flexion. In preferred embodiments, there is a spring that is connected through a flexible link to a main exercise engagement input arm via a variable ratio cam such that it is designed to apply a varying torque to the arm as it travels through its normal range of motion during the exercise. This allows a separate resistance source, the intensity of which can be selected by the user to be proportional to their muscular capacity, to be applied directly to the user's back.

The weight of the trunk creates a significant independent torque load from gravity as it moves through the range of motion to train spinal extension around an instant rotation axis about the lumbar spine. To address this, a separate resistance source originating from a spring or other force increasing mechanism can be provided to act directly on the input arm to effectively offset the gravity effect on the trunk. The highest trunk gravity effect is when the user's trunk is disposed at its most horizontal disposition relative to the ground in an anterior flexed posture or posterior extension posture. Unlike an abdominal configuration, the apparatus cannot be counterbalanced in the same way since without the user on the machine, the counterbalance would lift the arm up to the start. For that reason, instead of applying a load to make the trunk lighter as it moves forward into flexion, the apparatus applies a higher resistive load at the end of the range of the exercise in the same direction as the main resistive load of fixed weight, as the trunk moves rearward where gravity has less effective torque. Although it works opposite of an abdominal machine, the effect of offsetting gravitational torque effects though use of a separate spring or other force increasing based resistive source is the same.

Figure 2:
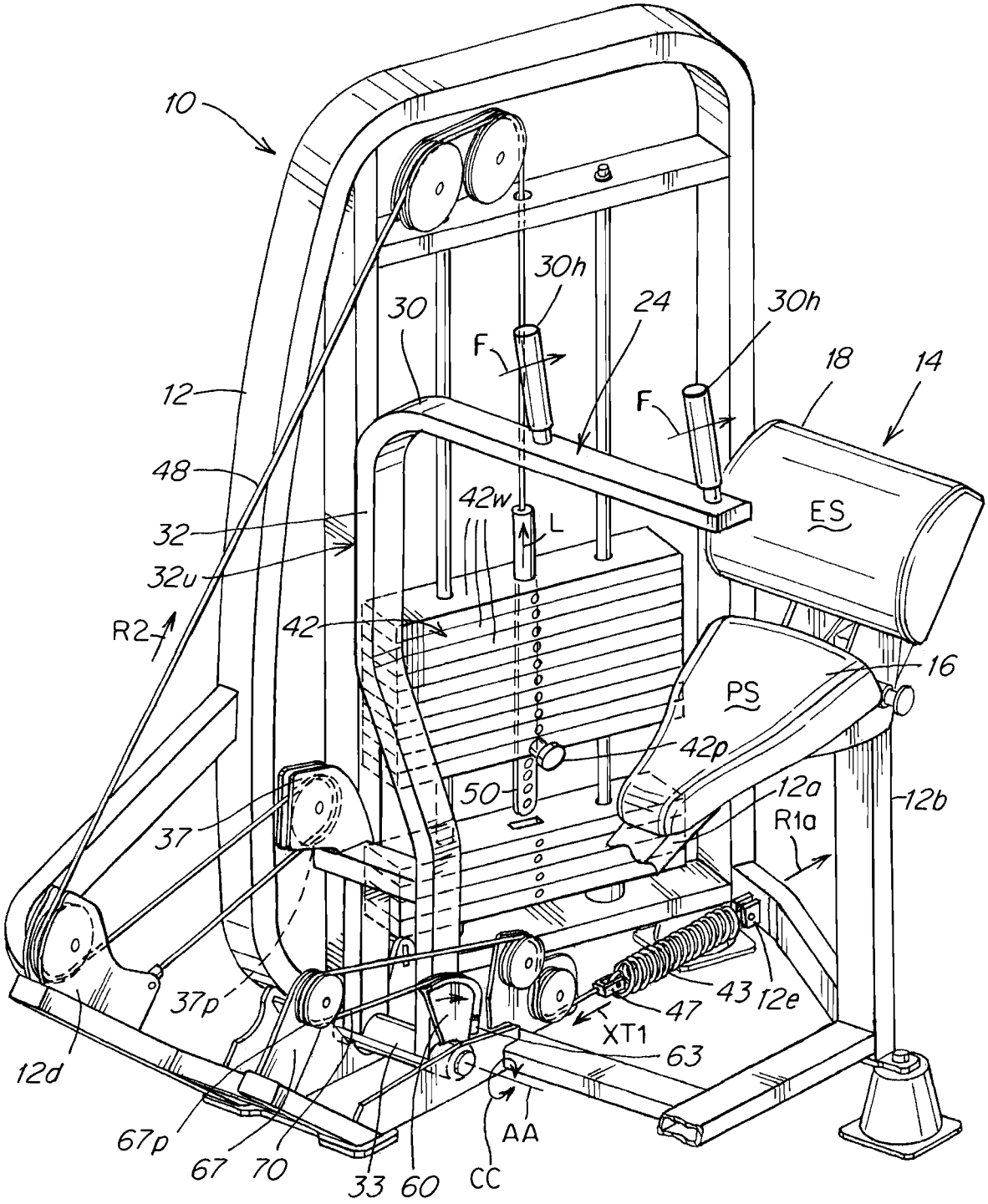
FIG. 2 is a view similar to FIG. 1 showing the input arm assembly in a rearwardly disposed position, 32*u*, relative to its starting motionless position.
Figure 2A:
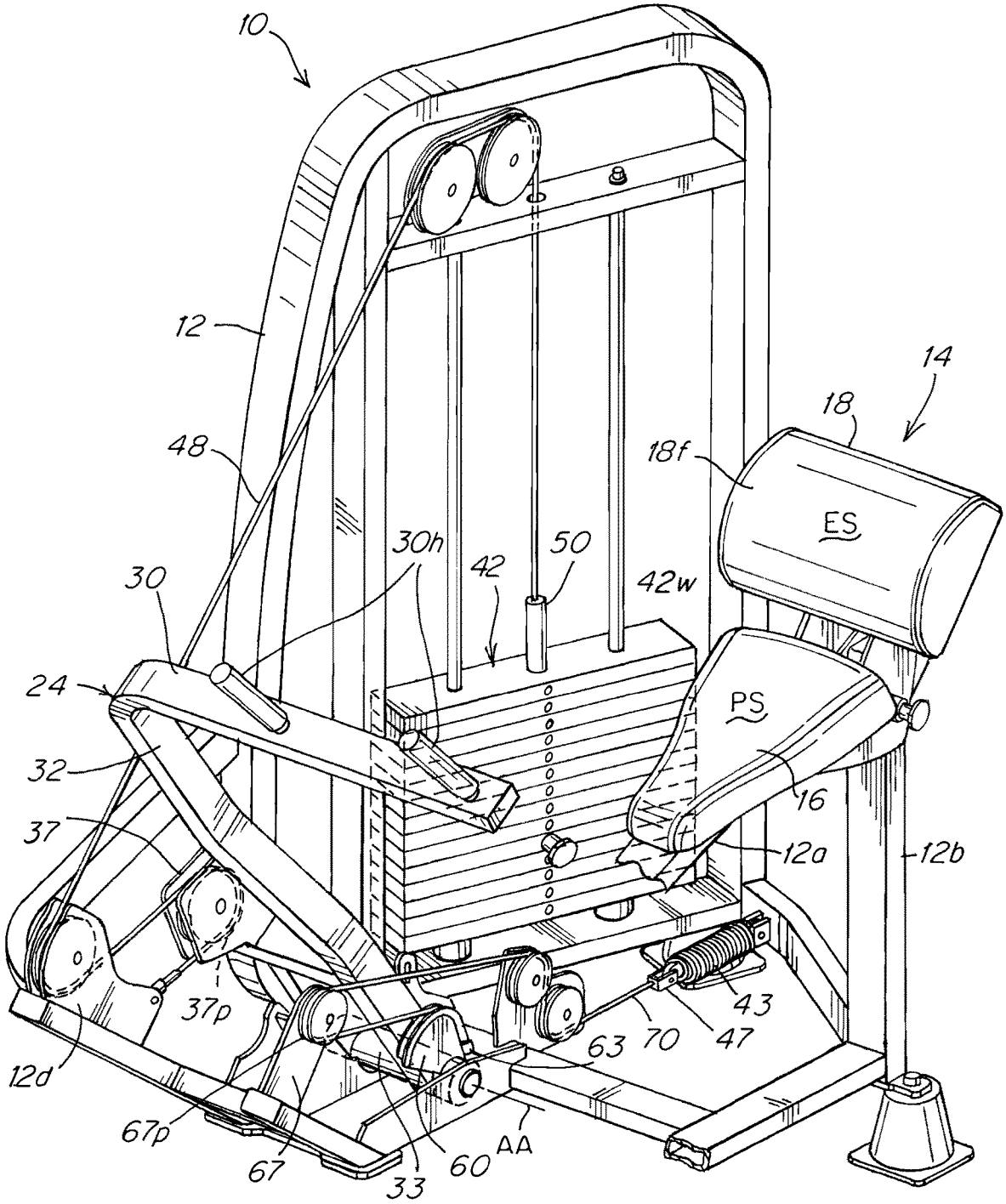
FIG. 2A is view similar to FIG. 2 showing the input arm assembly in its start motionless position.
Figure 2A:
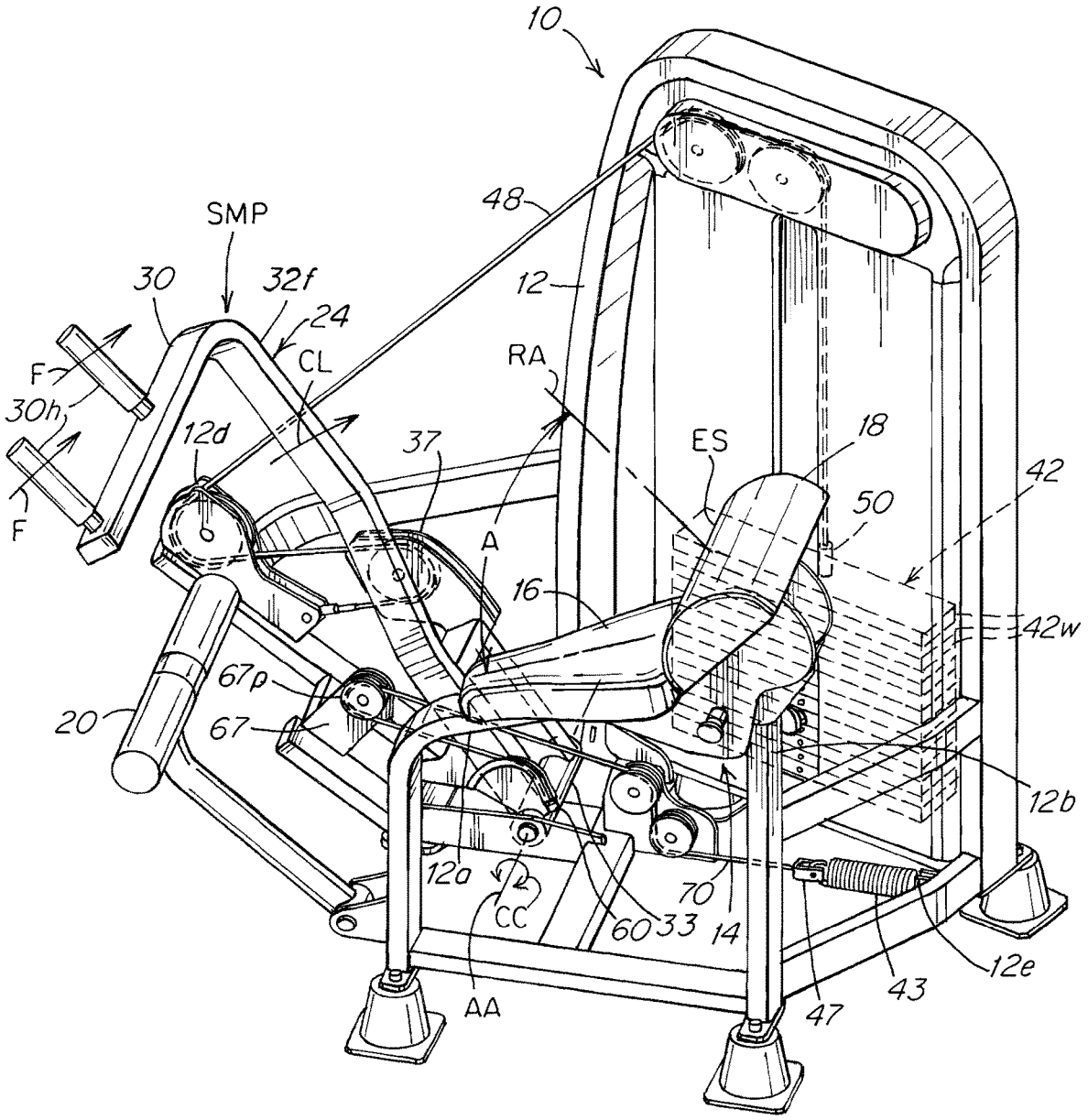
Figure 3:
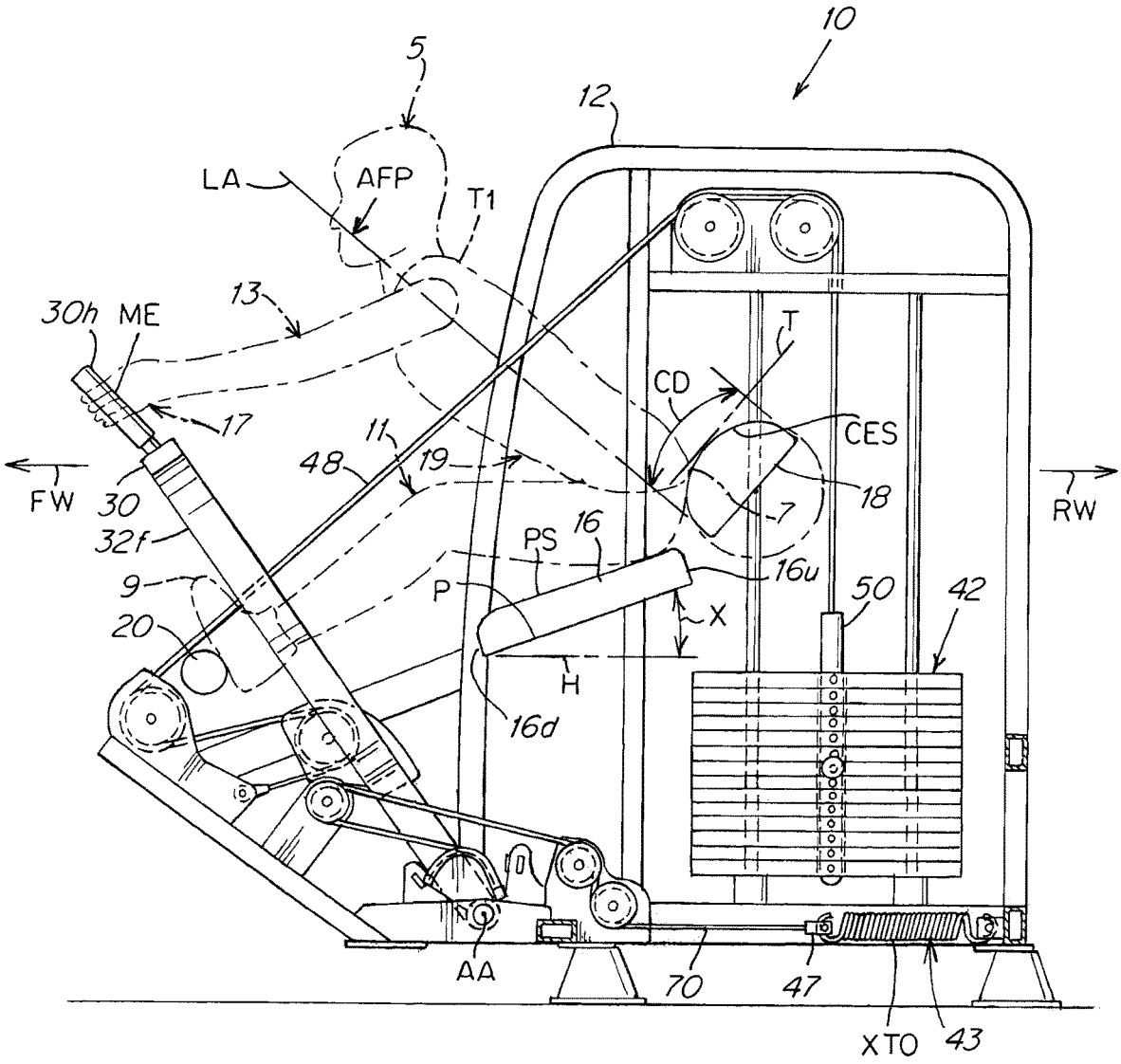
FIG. 3 is a side view of the FIG. 1 apparatus showing a user seated on the seat leaning forward grabbing the handles of the input arm assembly at the start of an exercise.

In an exemplary embodiment of the invention, as shown in FIGS. 1, 2, 3 a back extension machine 10 includes a support frame 12 on which a user support structure 14 is mounted. The user support structure 14 includes a seat 16 having a seat surface PS and a pelvic stabilizer pad 18 having a lower back engaging surface ES. The seat 16 is mounted on and supported by the forwardly facing upper portion 12*a* of the support frame 12 which is disposed at an angle X to horizontal H (greater than 90 degrees) to orient the seating surface PS at an angle X to horizontal H as well as to orient the tangent T of the pelvic stabilizer pad 18 at its own angle, typically an increased angle over angle X, relative to horizontal H. The seat 16 is positioned such that the user's lower back 7 and pelvic region abuts the engaging surface ES of the pelvic stabilizer pad 18 and the user's legs 11 extend forwardly FW and downwardly relative to the trunk T1, T2, T3. The pelvic stabilizer pad 18 is affixed to an upper end portion 12*b* of the support frame 12, is inclined rearwardly, and is curved CES in its forwarding facing surface CES in a substantially curved configuration, such as partially-circular CES in shape to accommodate for and engage with the user's lower back 7.

An adjustable footrest 20 is attached to the front of the support frame 12, where the oblique angle A of the seat 16 substantially directs the seat 16 down towards footrest 20. The footrest 20 is positioned so the user can apply a force using the leg muscles to push the pelvis rearwardly away from the user input arm 30 into the pelvic stabilization pad 18. The footrest 20 can be adjusted or pivoted back and forth (forward and backward) and up and down (vertically) with a footrest adjustment mechanism 22 to accommodate users of varying heights. When a user's feet are positioned on the footrest 20, the footrest 20 is typically adjusted such that the user's thighs are disposed in a position that is substantially parallel with the ground. Additionally, the seat 16, pad 18, footrest 20 are arranged, mounted and adapted such that the user's knees are preferably disposed in a flexion position of between about 10 degrees knee flexion to about 30 degrees knee flexion. This spatial arrangement of the pelvic stabilizer pad 18, seat 16, and footrest 20 combination effectively immobilize the user's pelvic area, preventing it from rotating in either the anterior or posterior direction.

An input assembly 24 comprised of a user engagement arm 30 is mounted to the frame, arranged, adapted and interconnected to a weight resistance (in this embodiment a weight stack 42 and a spring 43) with an input 30 that is positioned forwardly of the seat 16. The arm 30 is adapted and mounted to the support frame 12 for pivoting arcuate rotation about a horizontal axis AA. The horizontal arm 30 is pivotable about axis AA for arcuate front to back FW-RW movement by forcible pulling F on the handles 30*h* interconnected to the arm 30. The horizontal arm 30 is attached to a curved offset arm 32 that is attached to a bushing 33 that is rotatably CC mounted to the frame. As shown, FIGS. 1-7, arm 32 is attached via a link 39 to bracket 37 on which a pulley 37*p* is mounted around which a cable 48 is wound, one end of the cable 48 being interconnected to frame bracket 12*d*, the other end of cable 48 being interconnected to the lifting post 50. Bracket 37 and its associated pulley 37*p* are pivotably rotatable CC together with arm 32 around axis AA. As arm 32 is pivoted rearwardly RW, cable 48 is concomitantly pulled rearwardly RW around the pulley 37*p* thus lifting post 50 and however many fixed weight plates 42*w* are attached to the post 50 via pin 42*p*. As bracket 37 and its associated pulley 37*p* are pivoted rearwardly, resistance force R2 is exerted against the pulling force F exerted by the user 5.

Similarly as arm 32 is pivoted CC rearwardly RW beginning from the start motionless position SMP to a rearward position 32*u*, 32*r*, the spring 43 is pulled into an extended disposition by a second cable 70 interconnected between the arm 32 and the spring 43. As shown in FIGS. 3-6B, the cable 70 is connected to the arm 32 via an attachment member 63 disposed at the base of a cam mechanism 60. The cam mechanism 60 is fixedly connected to the arm 32 in a manner such that the cam 60 rotates or pivots together with pivoting PT2 of the arm 32. The cam 60 is provided with a circumferential cable receiving groove CP, FIG. 6A around which the cable 70 is routed. The cable 70 is further routed around a pulley 67*p* that is rotatably mounted on a bracket 67 that is fixedly attached to the frame 12. The distal end of the second cable 70 is fixedly interconnected to a bracket 47, 47*a*, 47*b* that is connected to the proximal end of the spring 43.

Figure 6:
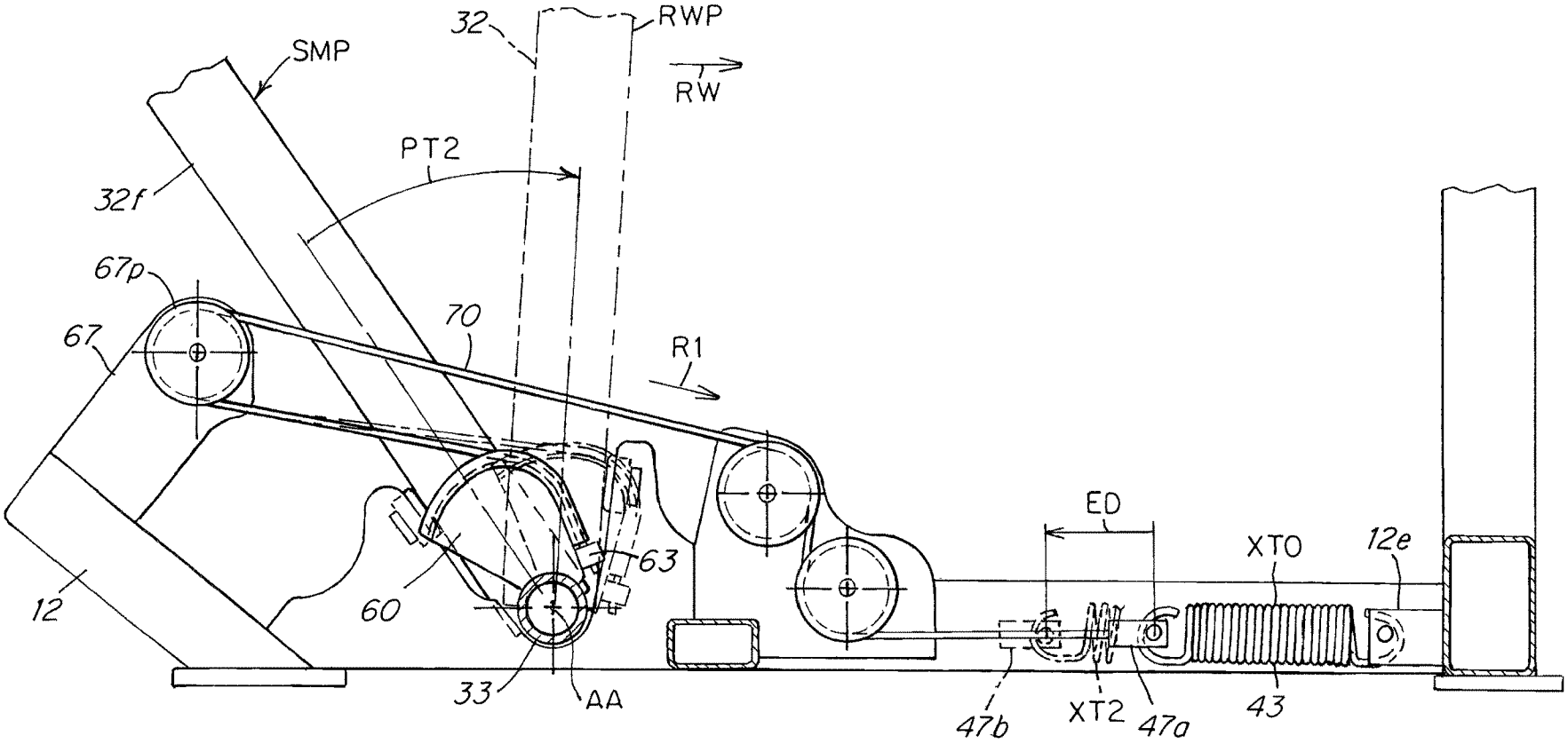
FIG. 6 is a side view of certain of the components of the apparatus in particular showing the pivoting arm of the input arm assembly in forward and rearward positions together with the cam and spring components.
Figure 6A:
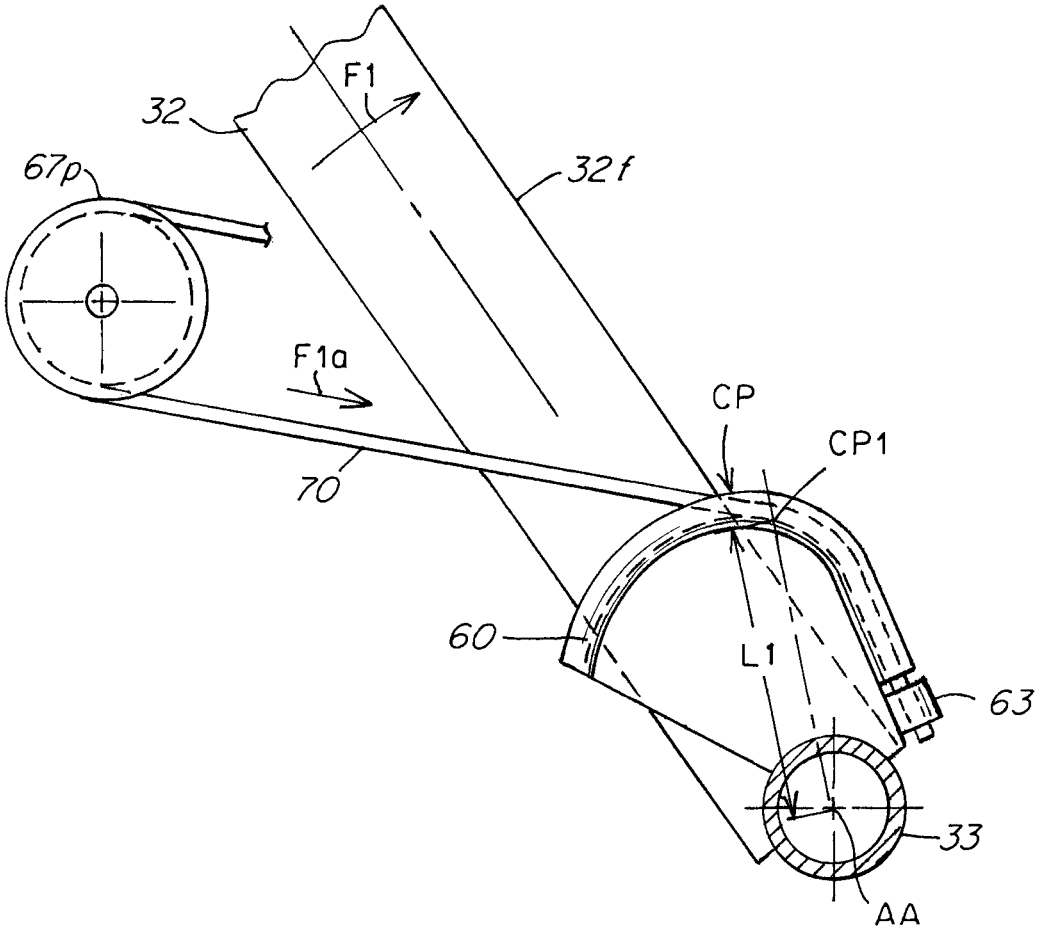
FIG. 6A is a schematic enlarged side view of the arm, cam, cable, pulley and pivot components associated with operation of the input arm assembly disposed in the start motionless position of the arm assembly.
Figure 6B:
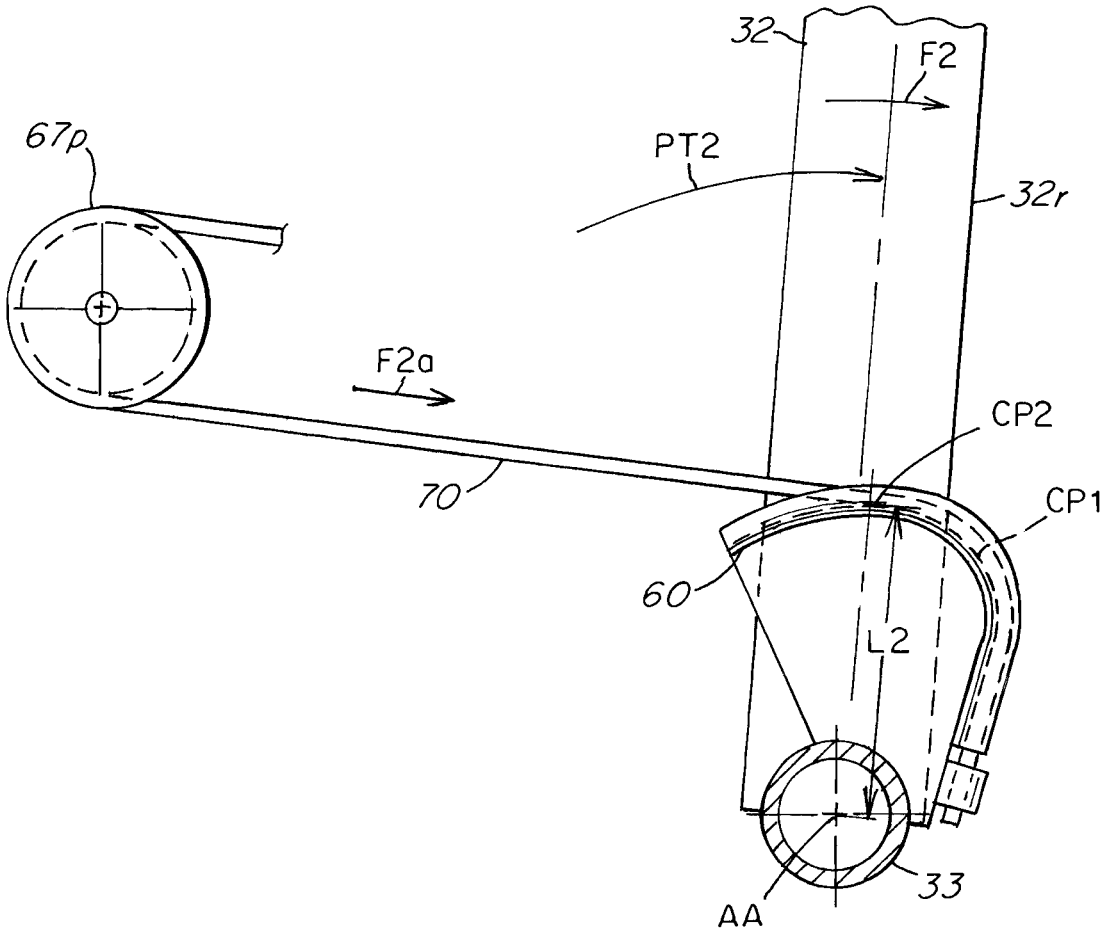
FIG. 6B is a schematic enlarged side view of the arm, cam, cable, pulley and pivot components associated with operation of the input arm assembly disposed in a rearwardly disposed position relative to the start motion position.

In a preferred embodiment, the circumferential groove CP in the cam member 60 is contoured and configured CP1, CP2 to control the degree of torque force exerted by the user against the spring according to the degree of rotation of the arm 32 such that the user feels a more smooth transition of force exertion F1*a* beginning from a start 32*f* no force position SMP further along to the torque force F2*a* at a rearwardly pivoted position 32*r* when and while the user continues to pull F2 on the arms 30, 32, FIGS. 6A, 6B. At the start position SMP, 32*f*, the radius L1 of the cam profile CP1 is lower than the radius L2 at the cam profile position CP2 such that the leverage force F1 required to rotate the arm 32 at the beginning of the exercise is less than the leverage force F2 required when the cam 60 has been rotated PT2 to a position where the radius L2 of the profile CP2 is greater. Thus the user is required to exert less force torque force F1 at the beginning of the exercise when the user's trunk weight T1 is at its maximum opposing force. As shown in FIG. 6, when the arm 32 is pivoted PT2 rearwardly RW, the spring 43 extends by an extension distance ED to the XT2 position. The larger the extension distance ED, the larger the resistance force R1 will be exerted against the user's pulling force.

A selected number of incremental weights 42*w* making up a weight stack 42 are selectively interconnectable via a pin 42*p* to the pivoting arm 30, 32 via connection of one end of a cable 48 to a manifold or lifting post 50 that is selectively interconnectable to a selected number of the incremental weights by inserting a pin 42*p* in one of a plurality of holes provided in a lifting post 50 that passes vertically through the incremental weights or plates 42*w*, as is well known in the art. For example, the weight stack 42 is formed by a stack of rectangular, brick-shaped plates. Each plate 42*w* typically has at least one horizontal channel or hole, wherein the pin 42*p* may be disposed to slidably engage any of a series of horizontal channels which are vertically spaced on the lifting post 50 to match the vertical spacing of the stacked weight plates 42*p*. The pin thereby engages a portion of the stack of weight plates 42*w*, such that when vertical force is applied to the lifting post 50 via the cable that is interconnected to pivotable arm 30, 32, the selected stack of weight plates 42*w* is moved upwards to create a resistance. Typically, the weight stack 42 apparatus is oriented such that the further down the pin is entered into the lifting post 50, the greater the number of plates 42*w* are engaged, thereby increasing the resistance R2 of the weight stack 42 machine.

In the present invention the apparatus includes a second cable 70, one end of which is connected to the input arm assembly, the cable 70 being mounted within the outer circumferential groove of a guide cam member 60. The opposite end of the cable 70 is connected to an increasing force resistance mechanism such as a spring 43. The cable 70, spring 43, arms 30, 32 and cam 60 are arranged, interconnected and adapted such that when the arms 30, 32 are forcibly pulled by the user in a clockwise direction CL, the cable 70 pulls on a connector 47 attached to the end of the spring 43 which exerts an opposing resistance force to whatever pulling force F is applied to arms 30, 32 by the user or otherwise. The circumferential groove CP1 in the cam member 60 is contoured and configured to control the degree of force exerted by the user against the spring such that the user feels a more smooth transition of force exertion from a start, no force position and an operational position when the user starts pulling F on the arms 30, 32.

Figure 4:
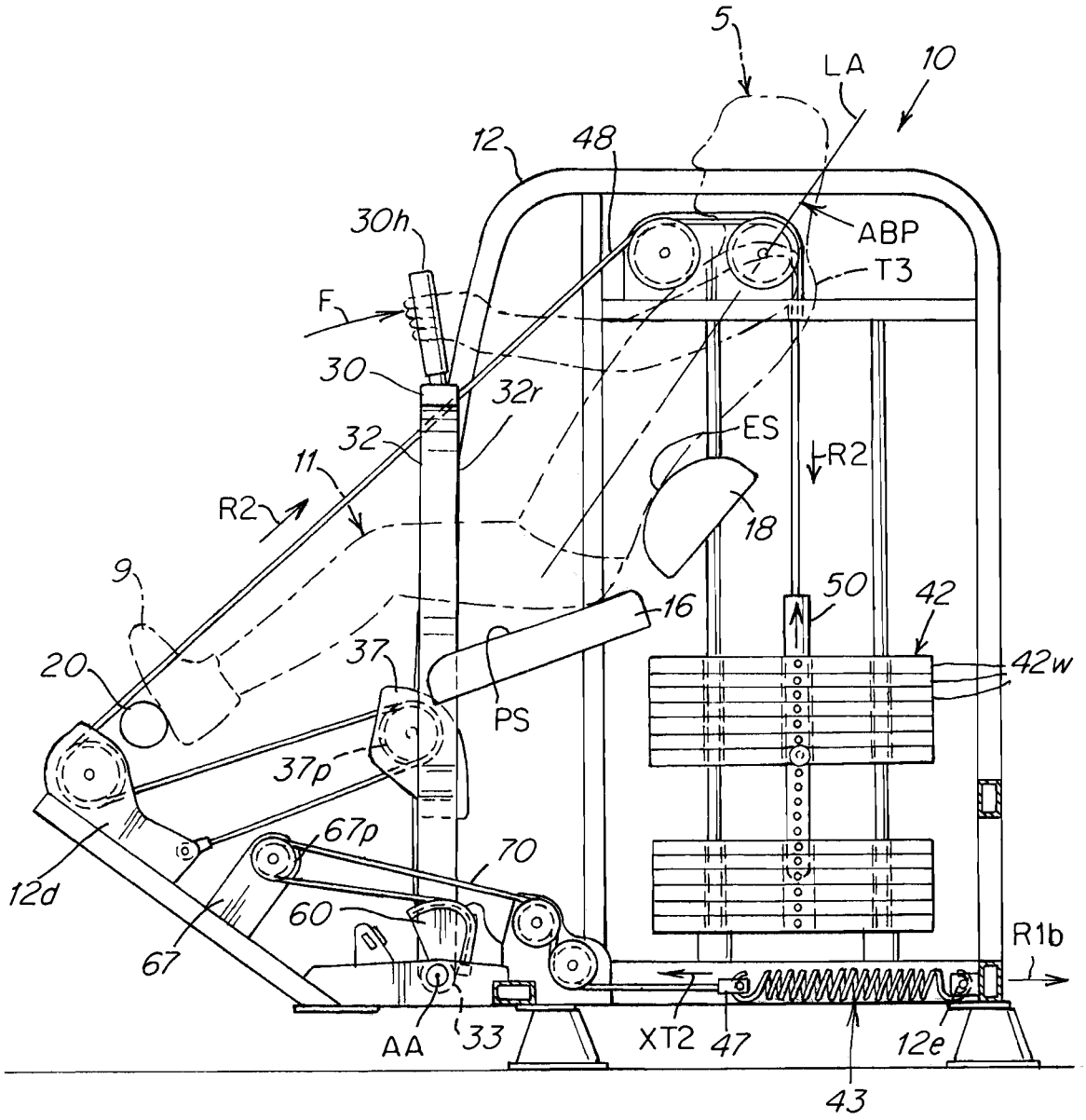
FIG. 4 is a side view of the FIG. 1 apparatus showing a user having pulled the input arm assembly to a nearly vertical position with the user's torso or trunk having been pivoted rearwardly to a position where the longitudinal axis of the user's torso has traveled past vertical.

FIGS. 1, 4 shows the seat 16 having a generally planar seating surface PS that lies generally in a plane P at an obtuse angle X relative the central radial axis of the lower back engagement surface ES of the back pelvic stabilization pad 18, the pelvic stabilization pad 18 having a lower back engagement surface ES having a central radial axis RA. The seating surface PS being generally disposed in a plane P that is disposed at a downwardly sloping angle X relative to horizontal, the seating surface PS and the lower back engagement surface ES being mounted, adapted and arranged relative to each other such that the seating surface PS and the central radial axis RA are disposed at an obtuse angle A relative to each other. As shown, the lower back engagement surface ES is preferably generally circular in cross-section, the central radial axis RA extending from or intersecting the center of a circle COC in which the circular circumference is disposed and also through the center CES or half way around the cross-section circumferential distance CD of the generally circumferential surface ES.

Figure 5:
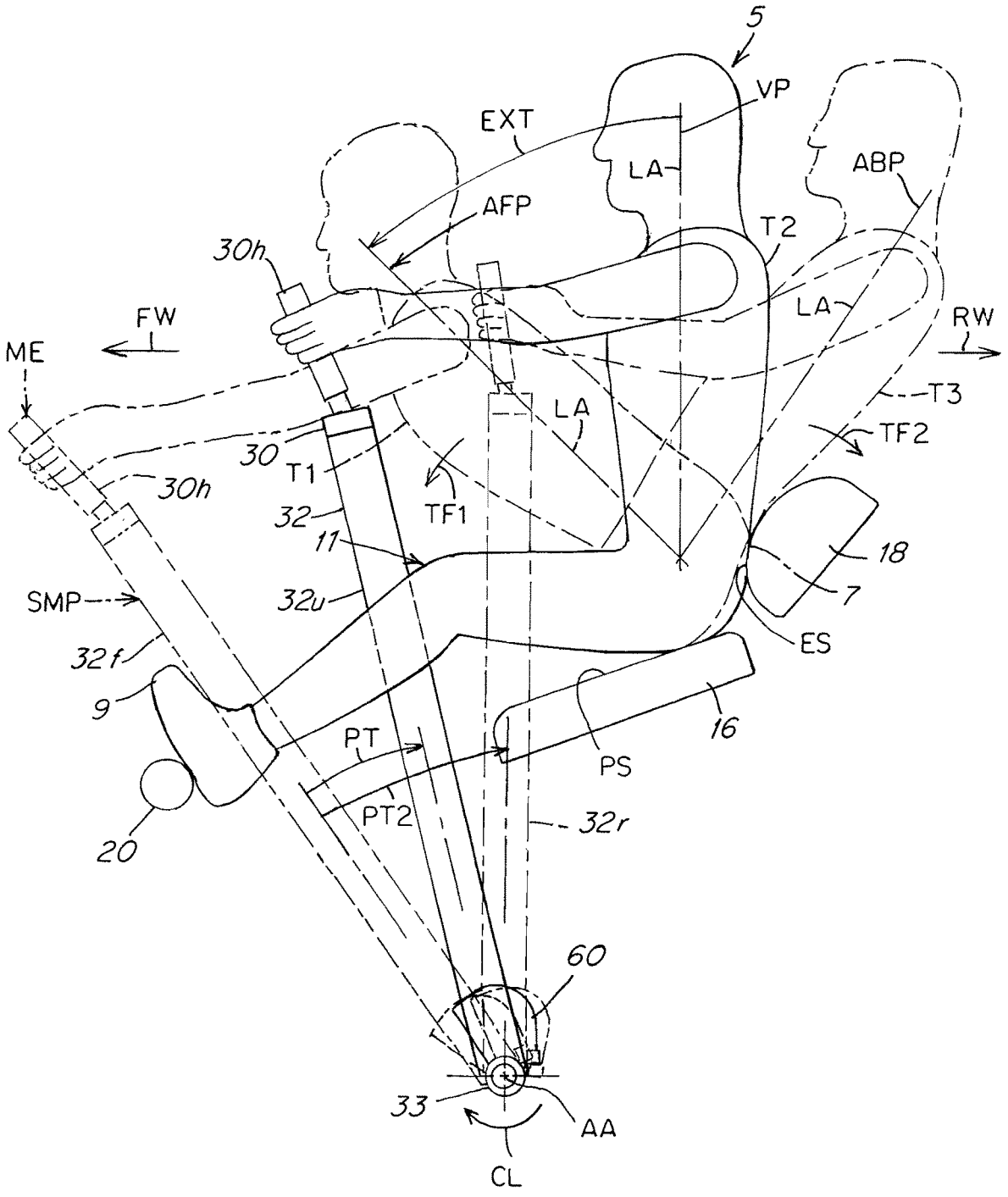
FIG. 5 is a schematic side view of a user's body in various angular orientations when seated in proper position on the seat of an apparatus of FIGS. 1-4 for performance of a back extension exercise using an apparatus of FIGS. 1-4.

In performing a typical back extension exercise, the user 5, FIG. 5, initially seats themselves on the sloped seat surface PS and engages at least one foot 9 on the foot pad or foot support 20 which is stationarily mounted to the frame 12, FIGS. 1-4. The user 5 then pushes with their legs and knees 11 against the stationarily mounted foot support 20 to force the user's trunk T1, T2, T3 to move rearwardly RW toward the pad 18 to a degree or length such that the user's lower back 7 is pushed into engagement with the lower back engagement surface ES of the pelvic stabilization pad 18. Once the user's lower back 7 is engaged with the surface ES, the user then leans at an angle EXT forwardly FW such that the longitudinal axis LA of the user's trunk T1 is in an angled forward position AFP at which the user can manually extend the user's arm(s) 13 forwardly FW and manually engage and hold ME the handles 30*h* of the pivoting arm 30 with or via the user's hand 17. Next the user exercises the user's abdominal 19 and lower back 7 muscles to move the user's trunk rearwardly from the position T1 toward or to the generally vertical VP position T2 while holding the handles 30*h* thus pulling the arm 30 from the rest or start motionless position SMP through an arcuate path of travel PT against the opposing force R1, R2 of either or both of the force resistance mechanisms 42, 43. As the user pulls the arm 30 from the user position T1 to T2, FIG. 5, at least one of the resistance mechanisms exerts an increasing amount of force R1, R1*a*, R1*b* that increases with the increasing degree of rearward RW movement of the arm 30 from its starting position 32*f* to or toward its rearward more vertical positions 32*u*, 32*r*. When the user's trunk is disposed in the starting position T1, the weight of the user's trunk T1 exerts its own torque force TF1 around the user's lower back 7 as a result of torque around the user's lower on the user's abdominal muscles and lower back muscles. The torque force TF1 is in the same direction against the lower back 7 as and adds to the resistance forces R1, R2.

As the user's trunk travels from the forwardly FW angled EXT position T1 toward the more vertically disposed VP position T2, the inherent weight of the user's trunk lessens to the point where at the vertical position VP, the weight of the user's trunk T2 does not exert further torque force against the user's abdominal 19 muscles or lower back 7 muscles.

As shown in FIG. 5, it is possible for the user to lean even further rearwardly RW from the vertical position VP pulling the arm 30 further rearwardly RW such that the user's trunk T3 is pivoted to a rearward position AFB where the weight of the user's trunk T3 now exerts another torque force TF2 that opposes, not adds to, the forces R1, R2 of the resistance mechanisms 42, 43.

As shown in FIGS. 1-4, 6, the increasing force mechanism is comprised of a spring 43 that is adapted not to exert any force R1 when the arm 30 is in the start motionless position SMP, FIG. 1. When the arm 30 is moved from the start motionless position SMP rearwardly RW to a rearwardly angled position PT, PT2 such as shown in FIGS. 2, 4, the spring is extended from an initial, typically relaxed, position XT0 as shown in FIG. 3, to a more extended position, XT1, XT2, as shown in FIGS. 2, 4, 6 to exert a force R1*a*, R1*b* that opposes or resists the user's pulling force F, the spring force R1*a*, R1*b* increasing as the spring is increasingly extended such as between the spring positions XT1, XT2 of FIGS. 2, 4, 6, the spring 43 exerting an increased force R1*b* in the position XT2 shown in FIG. 4 over the force R1*a* exerted in the position XT1 shown in FIG. 2 because the spring 43 has been increasingly extended as a result of the increased angular movement of arm 30 from angle PT to angle PT2.

Figure 7:
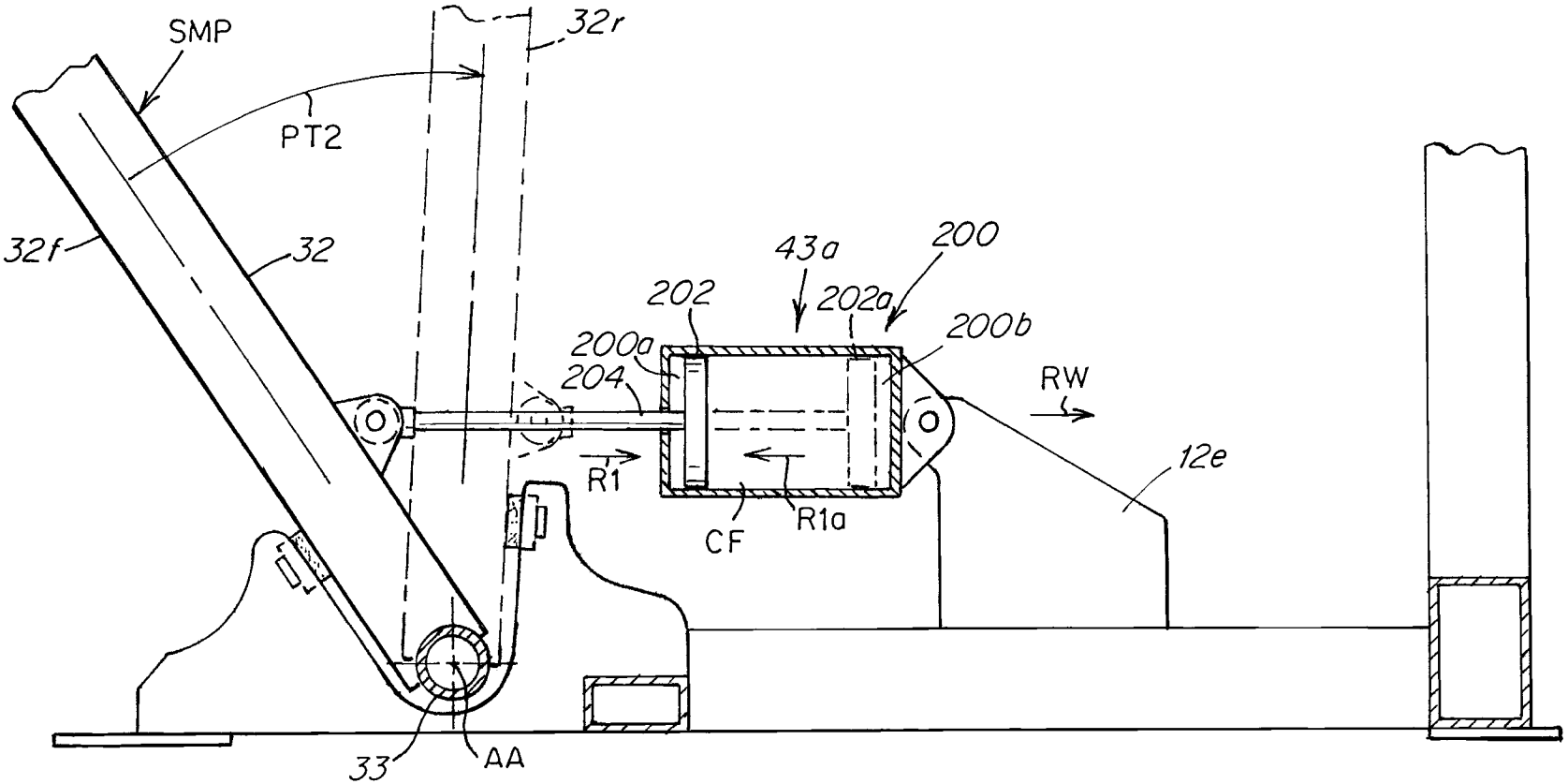
FIG. 7 is a schematic side view of the arm and pivot components of an apparatus according to the invention in an alternative embodiment where the arm assembly is interconnected to increasing force resistance mechanism comprised of a fluid cylinder and piston-rod assembly.

FIG. 7 illustrates in schematic an alternative increasing force resistance mechanism 43*a* which is comprised of an enclosed cylinder 200 having a piston 202 slidably mounted within the cylinder forming opposing fluid sealed chambers 200*a*, 200*b* within the cylinder 200, the piston 202 being interconnected to a rod 204 that extends outside the enclosed cylinder for driving the piston 202 from an initial start position 202 to a resistance position 202*a*, the chambers 200*a*, 200*b* containing a selected compressible fluid, the rod being interconnected to the input arm assembly 30 and driven by movement of the input arm assembly from the start motionless position, 32*f*, SMP toward the pelvic stabilization pad 18 to cause fluid CF in at least one of the chambers to compress and increase in resistance force R1*a* against movement PT2 of the input arm assembly with an increase R1*a* in the degree of compression of the fluid CF on continued movement of the piston 202*a* to a position where the fluid CF is more compressed. As shown, the rod 204 is pivotably interconnected to arm 32 and the cylinder is interconnected to the frame member 12*e* such that as arm 32 is pivoted rearwardly PT2 the rod 204 and its interconnected piston 202 are driven rearwardly RW reducing the volume of chamber 200*b* and compressing the fluid CF which increases R1*a* as the degree of rearward travel increases.

In alternative embodiments, other mechanisms for providing increasing resistance R1, such as friction fittings, springs, elastic bands, pneumatic, hydraulic or electromagnetic resistance, or an air resistance fan could be employed (either alone or in combination) and still practice the invention.

What is claimed is:

1. An exercise apparatus for performing a back extension exercise by a user having a lower back, legs and a trunk that has a longitudinal trunk axis and a trunk weight, the apparatus comprising:

a stationary frame, a seat having a seating surface and a pelvic stabilization pad having a lower back engagement surface, the seat and pad configured to be mounted in fixed positions on the stationary frame during the back extension exercise, an input arm assembly interconnected by a first interconnection to a first resistance mechanism, the input arm assembly including a manually graspable mechanism and being arranged on the stationary frame such that the input arm assembly is pivotable with respect to the stationary frame beginning from a start motionless position along a path of travel rearwardly toward the pelvic stabilization pad under resistance exerted by the first resistance mechanism, the seating surface and the pelvic stabilization pad being mounted, adapted and arranged on the stationary frame in a disposition such that the user can simultaneously sit on the seating surface, engage the user's lower back against the lower back engagement surface and manually engage the manually graspable mechanism to pull the input arm assembly against resistance exerted by the first resistance mechanism, wherein the first resistance mechanism is adapted to increase resistance as the degree of pivoting of the input arm assembly increases along the path of travel away from the start motionless position rearwardly toward the pelvic stabilization pad, and wherein the apparatus includes a second interconnection to a second manually selectively adjustable fixed weight resistance mechanism.

2. The exercise apparatus of claim 1 wherein the input arm assembly is arranged on the apparatus such that when the user is seated on the seating surface and the user's lower back is engaged against the lower back engagement surface, the seat and the pelvic stabilization pad position the user in a position at which the user can manually engage the manually graspable mechanism to pull the input arm assembly beginning from the start motionless position toward the pelvic stabilization pad along the path of travel against resistance (R1, R2) exerted by one or both of the first and second resistance mechanisms.

3. The apparatus of claim 1 wherein the seat and the pelvic stabilization pad are arranged on the apparatus such that when the user is seated on the seat with the user's lower back engaged against the lower back engaging surface and the input arm assembly is disposed in the start motionless position, the user's trunk axis is disposed at a forward angle relative to vertical leaning forwardly away from the pelvic stabilization pad and toward the input arm assembly when the user manually engages the manually graspable mechanism.

4. The apparatus of claim 3 wherein the seat and the pelvic stabilization pad are arranged on the apparatus such that when the user manually engages and pulls the input arm assembly from the start motionless toward the pelvic stabilization pad, the user's trunk axis pivots backwardly from the forward angle and travels from the forward angle toward a vertical disposition, the user's lower back being opposed by less force from the trunk weight and more resistance from the first resistance mechanism as the user's trunk axis approaches a vertical disposition.

5. The exercise apparatus of claim 1 wherein the first resistance mechanism comprises either (a) an extendable spring that increases in resistance as the spring is increasingly extended, the spring being interconnected to the input arm assembly in an arrangement such that movement of the input arm assembly along the path of travel toward the pelvic stabilization pad increasingly extends the spring and movement toward the start motionless position reduces extension of the spring or (b) an enclosed cylinder having a piston slidably mounted within the cylinder forming opposing fluid sealed chambers within the cylinder, the piston being interconnected to a rod that extends outside the enclosed cylinder for driving the piston, the chambers containing a selected compressible fluid, the rod being interconnected to the input arm assembly and driven by movement of the input arm assembly from the start motionless position toward the pelvic stabilization pad to cause fluid in at least one of the chambers to compress and increase resistance against movement of the input arm assembly with an increase in the degree of compression of the fluid.

6. The exercise apparatus of claim 1 wherein the lower back engagement surface is generally circular in radial cross-section.

7. An exercise apparatus for performing a back extension exercise by a user having a lower back, legs and a trunk that has a longitudinal trunk axis and a trunk weight, the apparatus comprising:

a stationary frame, a seat having a seating surface and a pelvic stabilization pad having a lower back engagement surface, the seat and pad configured to be mounted in fixed positions on the stationary frame during the back extension exercise, an input arm assembly interconnected by a first interconnection to a first resistance mechanism, the input arm assembly including a manually graspable mechanism and being arranged on the stationary frame such that the input arm assembly is pivotable with respect to the stationary frame beginning from a start motionless position along a path of travel rearwardly toward the pelvic stabilization pad under resistance exerted by the first resistance mechanism, the seating surface and the pelvic stabilization pad being mounted, adapted and arranged on the stationary frame in a disposition such that the user can simultaneously sit on the seating surface, engage the user's lower back against the lower back engagement surface and manually engage the manually graspable mechanism to pull the input arm assembly against resistance exerted by the first resistance mechanism, wherein the first resistance mechanism is adapted to increase resistance as the degree of pivoting of the input arm assembly increases along the path of travel away from the start motionless position rearwardly toward the pelvic stabilization pad, and wherein the seating surface is generally disposed in a plane disposed at a downwardly sloping angle relative to horizontal, the seat having a downwardly disposed front end and an upwardly disposed rear end, the pelvic stabilization pad being mounted such that the lower back engagement surface is disposed at the upwardly disposed rear end of the seating surface in an arrangement that engages the user's lower back when the user is seated on the seating surface and pushing the user's lower back toward the pelvic stabilization pad with the user's legs.

8. The exercise apparatus of claim 7 wherein the apparatus includes a foot pad mounted forwardly relative to the seat, the foot pad being arranged on the apparatus such that the user can engage the foot pad with the user's foot and push on the foot pad with the user's leg to push the user's lower back into engagement with the lower back engagement surface while seated on the seat.

* * * * *